United States Patent [19]

Robinson et al.

[11] Patent Number: 4,877,235

[45] Date of Patent: Oct. 31, 1989

[54] CURRENCY SORTER AND STORAGE DEVICE

[75] Inventors: Larry A. Robinson, Boise, Id.; Richard R. Robinson, Red Feather Lakes, Colo.

[73] Assignee: Tidel Systems, Inc., Carrollton, Tex.

[21] Appl. No.: 218,954

[22] Filed: Jul. 14, 1988

[51] Int. Cl.[4] ..... B65H 29/22

[52] U.S. Cl. ..... 271/279; 209/534; 209/706; 211/51; 232/1 D; 271/219; 271/220

[58] Field of Search ..... 270/95; 232/1 D; 271/180, 278, 279, 215, 217, 219, 220, 9, 3.1; 346/1 NQ; 209/534, 706; 211/51; 194/1 NQ; 116/1 NQ

[56] References Cited

U.S. PATENT DOCUMENTS

| | | | |
|---|---|---|---|
| 1,613,354 | 1/1927 | Mathes | 211/51 X |
| 1,972,214 | 9/1934 | Bergman | 211/51 X |
| 2,923,587 | 2/1960 | Zipf | 232/1 D X |
| 3,092,433 | 6/1963 | Simjian | 232/1 D |
| 3,101,892 | 8/1963 | Reese . | |
| 3,791,392 | 2/1974 | Hanson | 271/3.1 UX |
| 3,892,309 | 7/1975 | Coffey | 211/51 X |
| 3,977,669 | 8/1976 | Douno . | |
| 4,753,431 | 6/1988 | Fujimoto | 271/180 X |

*Primary Examiner*—Richard A. Schacher
*Attorney, Agent, or Firm*—Frank J. Dykas; Craig M. Korfanta

[57] ABSTRACT

A currency sorter and storage device 10 which includes a lockable storage container 11 having a front plate 12 which further has a plurality of currency receiving slots 13 therein. A pair of rollers, one being drive roller 18 and the other idler roller 17, are disposed in parallel spaced relationship directly behind and on the interior side of currency receiving slots 13. An electric motor 19 provides a source of rotation for drive roller 18. A partitioned currency bin 14 having currency receiving chutes 15 therein, is disposed within lockable storage containing 11 such that currency receiving chutes 15 each lie directly below a particular currency receiving slot 13. A rotatable shaft 23 having one end extending through the side of lockable storage container 11 has a plurality of biasing dogs 22 radially attached. Biasing dogs 22 are disposed along rotatable shaft 23 to each engage a stack of currency 1 located in a particular currency receiving chute 15. A handle 24 is radially attached to the exterior end of rotatable shaft 23 to facilitate engaging or disengaging biasing dogs 22 with stacks of currency 1.

19 Claims, 9 Drawing Sheets

CURRENCY SORTER AND STORAGE DEVICE

BACKGROUND OF THE INVENTION

1. Technical Field

This invention generally relates to devices for the safe keeping of currency, and in particular this invention relates to a device for safely storing and sorting currency, both by denomination and chronological time of insertion.

2. Background Art

Retail outlets, such as grocery stores, gas stations, fast food stores and especially convenience stores, because of their numerous locations, hours of operation, and large amount of cash on hand, have become favorite targets for robberies. As a counter measure, store owners have installed deposit only safes, in which the clerk on duty can deposit money into the safe but cannot withdraw money out of the safe. A typical 24-hour convenience store, for instance, might run anywhere from three to six individual shifts, where each employee of a particular shift deposits money into the safe throughout his shift in order to limit accessible cash. While these safes serve well to help combat robberies, they create several new problems for the store accountant. Upon opening the safe, the store accountant finds a pile of currency of various denominations where each shift's deposit is indistinguishable from another.

A partial solution to the piling problem is offered by L. B. REESE, JR., U.S. Pat. No. 3, 101,892, which teaches a bill receiving cash box which holds bills in a stacked array. The device of REESE uses a pair of rollers to draw the bills into the interior of the box where they are deposited and held in a stacked array. REESE does not teach any way of separating the bills by either denomination or by chronological time of deposit, i.e. by shift.

A similar stacking device is taught by DOUNO, U.S. Pat. No. 3,977,669, which teaches a bill pusher which pushes bills drawn in through a slot down onto a stack. DOUNO's device uses a floating bottom which is spring biased upwardly. Like the device of REESE, the device of DOUNO does not make any provisions for separating the currency either by denomination or by shift.

What is needed is a secure storage device for currency which separates the currency both by denomination and by chronological time of insertion. It is therefore an object of this invention to provide such device.

DISCLOSURE OF INVENTION

This object is accomplished by a currency sorter and storage device which includes a lockable storage container having a plurality of currency receiving slots located in a front plate of the storage container. Each of the currency receiving slots corresponds to a separate currency denomination. The currency receiving slots are generally horizontally disposed and aligned coincident on a common axes. Directly behind the slots on the interior of the storage container are a pair of rollers used to draw currency in through the slots and to further provide a security mechanism which prevents currency from being withdrawn out through the slots. The bottom roller is the drive roller and is attached via a belt to a drive means, such as an electric motor. An idler roller is disposed parallel to and in contact with the drive roller and supported via a roller arm at each end. The roller arms have a retaining bearing located at one end for retaining the idler roller, a pivot hole located approximately at their center, and a spring connected at their other end. The other end of the spring is connected to the wall of the storage container such that the roller arms exert a downward pressure on the attached idler roller. The length of the arms is such that the range of motion of the idler roller is limited to prevent unauthorized entry to the storage container through the rollers.

Directly below each currency receiving slot is a currency receiving chute for retaining a specific denomination of currency. A slidable base is located in each currency receiving chute. The slidable bases are horizontally disposed within a chute and are spring loaded such that they are each in frictional engagement with the walls which define the chute. The purpose for the slidable base is so that as the stack of currency grows the slidable base slides further down the chute. A rotatable shaft is disposed parallel to the roller pair and has one end which extends to the exterior of the storage container. A plurality of biasing dogs are radially attached to the rotating shaft and are disposed to provide a downward pressure on the bill stack in each currency receiving chute. A handle is radially attached to the exterior end of the rotatable shaft which provides a means for disengaging the biasing dogs with the bill stacks and activating the drive means by a microswitch or the like. The biasing dogs can also be used as a backstop when in their upwardly disengaged position, for bills entering the storage container through the rollers.

A plurality of sets of shift separating cards are provided for separating currency by chronological time of insertion. Each set of cards has affixed thereon an identification mark signifying a particular shift or employee. For instance, the first set might all be blue which corresponds to the first four hour shift. The second set of currency separating cards might all be red corresponding to a second employee work shift and so on. At the end of each shift the employee simply inserts one card into each currency receiving slot. The store accountant can then segregate the cash receipts by shift which greatly aids in verifying each employee's daily receipts for cash accountability.

BEST MODE FOR CARRYING OUT INVENTION

Figure 1:
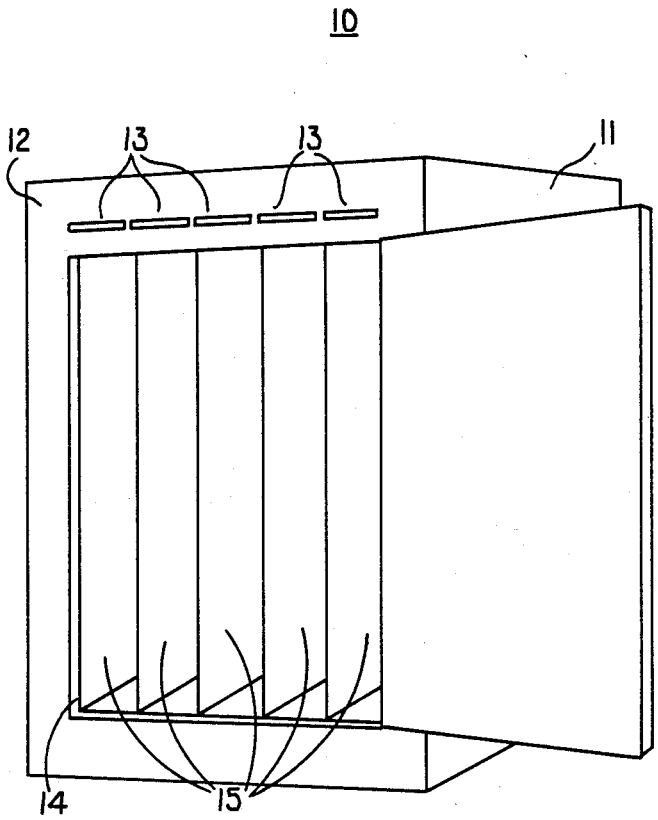
FIG. 1 is a front perspective view of a currency sorter and storage device.
Figure 2:
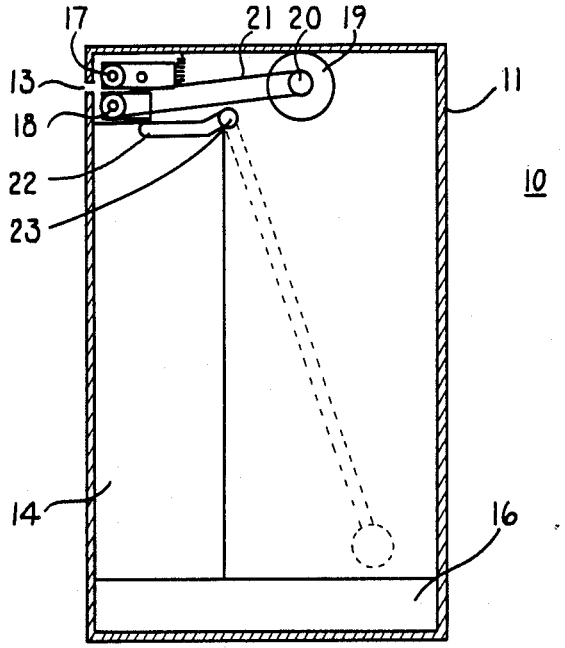
FIG. 2 is a first side sectional view of a currency sorter and storage device.

FIG. 1 shows lockable storage container 11, being generally rectangular in shape, and having a hinged door in front plate 12. A plurality of currency receiving slots 13 are horizontally disposed in front plate 12 and are aligned along a common horizontal axis. Partitioned currency bin 14 is located within lockable storage container 11 such that currency receiving chutes 15 each lie directly below currency receiving slots 13. FIG. 2 shows a pair of currency rollers, drive roller 18 and idler roller 17, disposed directly behind currency receiving slots 13 and rotatably attached to the side walls of storage container 11. A drive means, in this particular embodiment, electric motor 19 is provided to rotate drive roller 18 via motor pulley 20 and belt 21, in the clockwise orientation shown by the arrow in FIG. 2. Idler roller 17 rests against drive roller 18 and consequently rotates in the counterclockwise direction shown. A bin base 16 is provided in the bottom of storage container 11 for supporting partitioned currency bin 14.

Figure 3:
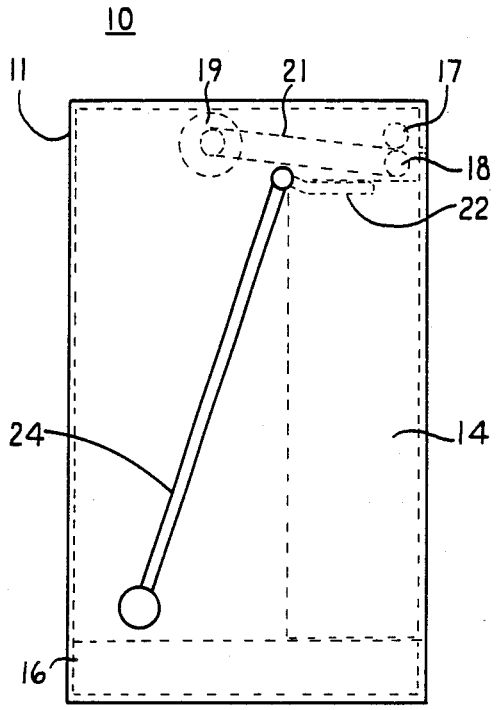
FIG. 3 is a second side view of a currency sorter and storage device.
Figure 4:
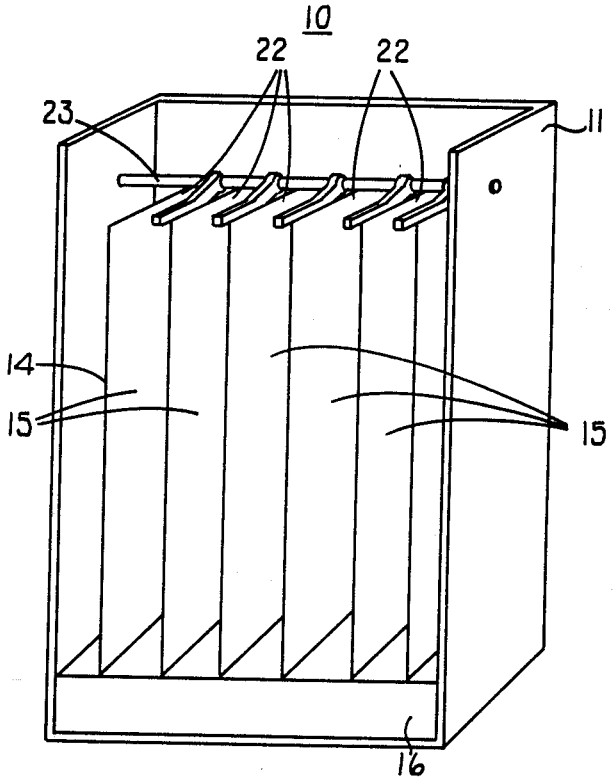
FIG. 4 is a partial front perspective view showing the biasing dogs and partitioned currency bin to advantage.

Referring now to FIGS. 3 and 4, the second side of currency sorter and storage device 10 is shown and has handle 24 radially attached to the exterior end of rotatable shaft 23. Rotatable shaft 23 has a plurality of biasing dogs 22 radially attached thereto and disposed directly above each currency receiving chute 15. When handle 24 is disposed in the position of FIG. 3, biasing dogs 22 will engage stacks of currency located in currency receiving chutes 15.

Figure 5:
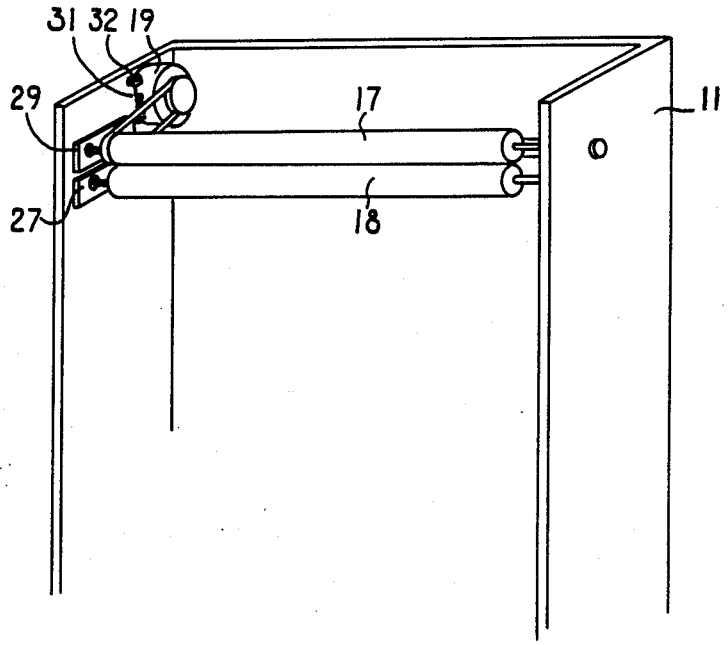
FIG. 5 is a partial front perspective view showing the roller assembly to advantage.
Figure 6:
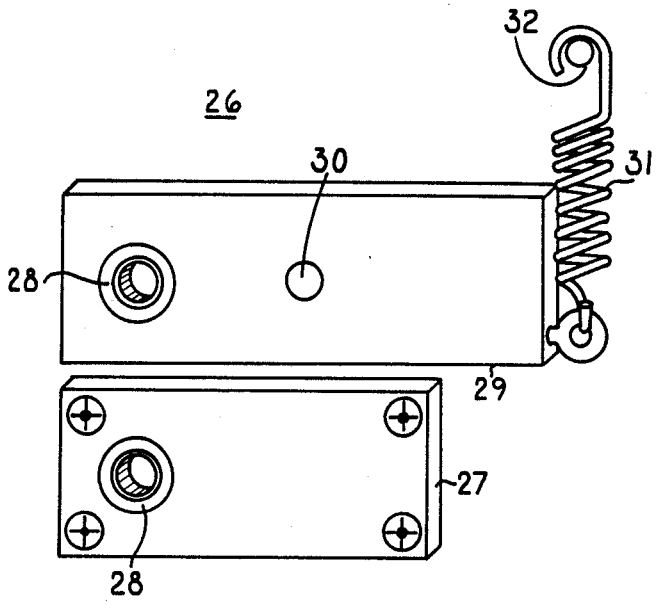
FIG. 6 is a side perspective view of a roller arm assembly.

In FIG. 5, drive roller 18 and idler roller 17 are shown in parallel spaced relationship and attached to opposite sides of storage container 11. Referring also now to FIG. 6, idler roller 17 is shown held in place by a pair of roller arm assemblies 26 located at each of its ends. Roller arm assembly 26 includes roller arm 29, having a retaining bearing assembly 28 disposed in one end, a pivot pin and hole 30 disposed at its center, and a biasing spring 31 attached at its other end. The two roller arms 29 are each pivotally attached to opposite sides of storage container 11 by attaching pivot pin 30 to the inside surface of the container sides. A pair of spring retainers 32 are similarly attached to each side of the inside side walls and are used for retaining the biasing springs 31 in a stretched state. A pair of drive roller supports 27 are attached in parallel spaced relation to roller arms 29 and are of shorter length such that as roller arm 29 is pivoted about pivot pin and hole 30 in the direction of a stretching spring, roller arms 29 will come into contact with drive roller supports 27 thereby limiting the range of motion of idler roller 17. This particular configuration provides added security in that the maximum opening between the rollers is limited.

Figure 7:
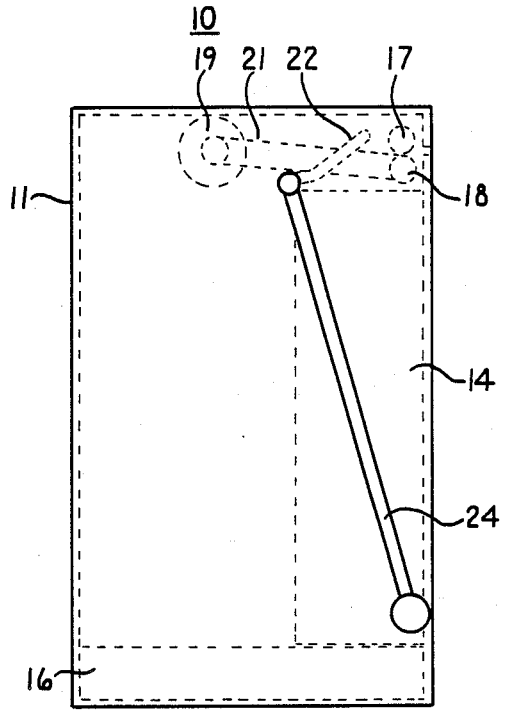
FIG. 7 is a second side view of a currency sorter and storage device showing the disengaged biasing dog position.

Handle 24 is shown, in FIG. 7, pulled forward so that biasing dogs 22 are in their disengaged position. A microswitch (not shown) is provided and is operable by handle 24 to activate electric motor 19. When biasing dogs 22 are positioned in their disengaged state, currency drawn in through rollers 17 an 18 are free to drop into their respective currency receiving chutes 15. Biasing dogs 22 also provide a backstop which tends to direct currency and/or currency separators into their currency receiving chutes 15.

Figure 8:
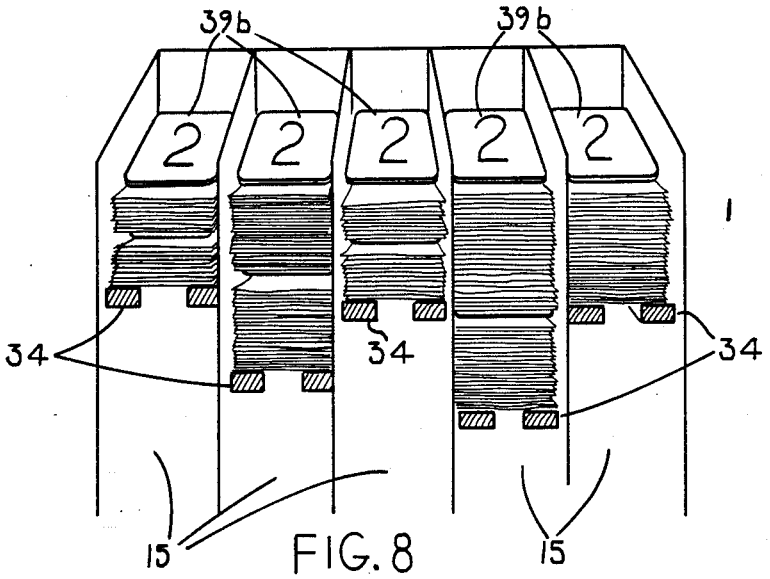
FIG. 8 is a perspective view of a partitioned currency bin having slidable bases therein.
Figure 9:
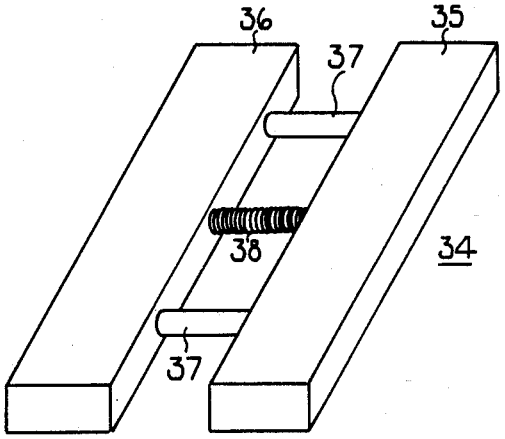
FIG. 9 is a top perspective view of a slidable base.

Referring now to FIG. 8, partitioned currency bin 14 is shown having stacks of currency 1, shift separators 39, and slidable bases 34 disposed within currency receiving chutes 15. Currency receiving chute 15 are defined by partition walls 33. Referring also now to FIG. 9, slidable base 34 includes a first base member 35 and second base member 36. First base member 35 has a pair of cross rods 37 attached to one edge which extend perpendicularly out therefrom. Second base member 36 has a pair of holes drilled in one edge disposed for receiving cross rods 37 of first base member 35. Both first base member 35 and second base member 36 have a hole drilled in the center of their adjacent edges for receiving cross spring 38. Slidable bases 34 are inserted into their respective currency receiving chutes by compressing cross spring 38 which subsequently expands and provides a frictional engagement means for engaging the partition walls 33.

Figure 10:
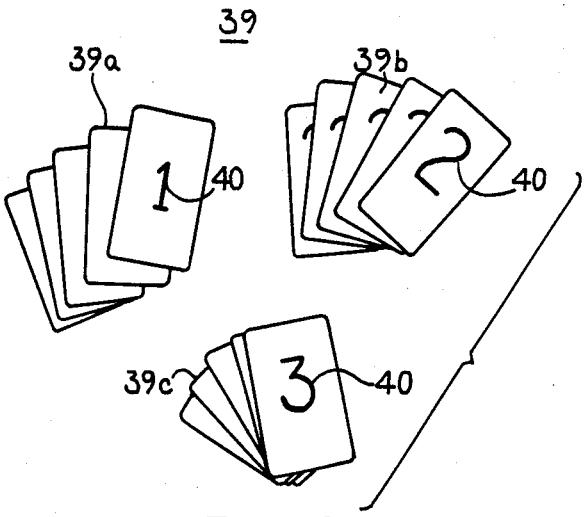
FIG. 10 is a top plan view of three sets of shift separators and shift defining indicia thereon.

A plurality of sets of shift separators 39 are provided, three of which are shown in FIG. 10 as **39*a*, 39*b* and 39*c*. Each set of shift separators 39 has a distinguishing indicia 40 thereon, set 39*a* using the number 1, set 39*b* the number 2, and set 39*c* using the number 3. It should be readily apparent that bill folders, envelopes or the like can easily be substituted for the card shift separators 39 shown in FIG. 10 as can the identifying indicia 40** easily be changed to simple color coding or the like.

A typical example for using a currency sorter and storage device 10 might be in a 24-hour convenience store having three employees each working 8-hour shifts. Employee number 1 comes on the job at 8:00 a.m. and throghout his 8-hour shift deposits several bills of each denomination in currency sorter and storage device 10. At 4:00 p.m., the end of his scheduled shift, the employee then inserts one shift separator **39*a* into each of the currency receiving slots 13. Employee number 2 starts his shift then at 4:00 p.m. and deposits various bills until 12:00 a.m. At that time employee number 2 then takes his set of shift separators 39*b* and inserts one in each currency receiving slot 13. Employee number 3, who works from 12:00 a.m. to 8:00 a.m. uses the same procedure with shift separators 39*c***. At any given time during the day or night the store accountant can open the safe and know exactly how much money and which denominations each employee deposited throughout their shift.

While there is shown and described the present preferred embodiment of the invention, it is to be distinctly understood that this invention is not limited thereto but may be variously embodied to practice within the scope of the following claims.

We claim:

1. A currency sorter and storage device which comprises:

a lockable storage container having a front plate, said front plate having a plurality of currency receiving slots;

a plurality of currency receiving chutes disposed and aligned within said container, each for receiving and holding currency inserted into said storage container through a currency receiving slot;

a pair of currency rollers held in parallel spaced relationship for receiving and transporting currency inserted through said currency receiving slots to the currency receiving chutes, said rollers rotatably mounted within the storage container behind said currency receiving slots;

means for rotating said rollers when currency is inserted through said currency receiving slots;

a rotatable shaft disposed in parallel spaced relation with said currency rollers and having one end extending to the exterior of said storage container;

a plurality of biasing dogs radially attached to said rotatable shaft, each of said dogs disposed for radial displacement about the axes of said rotatable shaft and for downwardly biasing currency in said currency receiving chute;

means for biasing currency into said currency receiving chutes; and means for separating currency in each chute by chronological time of insertion.

2. The device of claim 1 wherein said pair of rollers further comprise:

a drive roller operably attached to said rotating means; and an idler roller being spring biased, over a limited range of travel, against said drive roller, for providing a safety mechanism which prevents currency from being withdrawn from the interior of said storage container.

3. The device of claim 1 wherein the currency biasing means further comprises:

a plurality of slidable bases for upwardly supporting currency, said slidable bases being horizontally disposed and in frictional engagement with two adjacent partition walls which define said currency receiving chute; and a handle radially attached to the exterior end of said rotatable shaft for engaging and disengaging said biasing dogs with currency in said currency receiving chutes.

4. The device of claim 1 wherein the separation means comprises a plurality of sets of cards, each of said sets having a unique indicia thereon signifying a predetermined block of time.

5. The device of claim 1 wherein the separation means comprises a plurality of sets of folders, each of said sets having a unique indicia thereon signifying a predetermined block of time.

6. The device of claim 1 wherein the separation means comprises a plurality of sets of envelopes, each of said sets having a unique indicia thereon signifying a predetermined block of time.

7. A currency sorter and storage device which comprises:

a lockable storage container having a front plate, said front plate having a plurality of currency receiving slots;

a plurality of currency receiving chutes disposed and aligned within said container, each for receiving and holding currency inserted into said storage container through a currency receiving slot;

a drive roller rotatably disposed within said enclosure in parallel spaced relation with said currency receiving slots;

means for rotating said drive roller operably attached thereto;

an idler roller being spring biased, over a limited range of travel, against and in parallel spaced relation with said drive roller, for providing a safety mechanism which prevents currency from being withdrawn from the interior of said storage container;

a plurality of slidable bases for upwardly supporting currency, said slidable bases being horizontally disposed and in frictional engagement with two adjacent partition walls which define said currency receiving chute;

a rotatable shaft disposed in parallel spaced relation with said rollers and having one end extending to the exterior of said storage container;

a plurality of biasing dogs radially attached to said rotatable shaft, each of said dogs disposed for radial displacement about the axes of said rotatable shaft and for downwardly biasing currency in said currency receiving chute;

a handle radially attached to the exterior end of said rotatable shaft for engaging and disengaging said biasing dogs with currency in said currency receiving chutes;

means for separating currency in each chute by chronological time of insertion.

8. The device of claim 7 wherein the separation means comprises a plurality of sets of cards, each of said sets having a unique indicia thereon signifying a predetermined block of time.

9. The device of claim 7 wherein the separation means comprises a plurality of sets of folders, each of said sets having a unique indicia thereon signifying a predetermined block of time.

10. The device of claim 7 wherein the separation means comprises a plurality of sets of envelopes, each of said sets having a unique indicia thereon signifying a predetermined block of time.

11. A currency denomination sorter and storage device for use in a multishift environment, which comprises:

a lockable storage container;

a plurality of horizontal slots disposed in said enclosure for receiving currency therethrough;

a partitioned currency bin having a plurality of vertically disposed partition walls for separately retaining stacks of currency, said currency bin being positioned within said container so said partition walls vertically separate said horizontal slots;

a plurality of slidable bases for upwardly supporting said bill stacks, said slidable bases being horizontally disposed between and in frictional engagement with two opposing partition walls;

a plurality of biasing dogs radially attached to a rotating shaft, said rotating shaft being rotatably attached within said container and having one end extending to the exterior of said container, said rotating shaft disposed within said container so said biasing dogs fall coincident on said slidable bases;

a handle attached to the exterior end of said rotatable shaft for controlling said biasing dogs; and means for separating currency within said currency bin for segregation of said currency by shift.

12. The currency sorter and storage device of claim 11 wherein the currency separation means comprises a plurality of sets of cards, each of said sets having a unique indicia thereon for signifying an individual shift.

13. The currency sorter and storage device of claim 11 wherein the currency separation means comprises a plurality of sets of folders, each of said sets having a unique indicia thereon for signifying an individual shift.

14. The currency sorter and storage device of claim 11 wherein the currency separation means comprises a plurality of sets of envelopes, each of said sets having a unique indicia thereon for signifying an individual shift.

15. The currency sorter and storage device of claim 11 further comprising:

a pair of rollers horizontally disposed on the interior side of said horizontal slots one on top of the other;

drive means for rotating said rollers in opposing directions for drawing currency in through said slot to the interior of said container.

16. A currency denomination sorter and storage device for use in a multishift environment, which comprises:

a lockable storage container;

a plurality of horizontal slots disposed in said container for receiving currency therethrough;

a partitioned currency bin having a plurality of vertically disposed partition walls for separately retaining stacks of currency, said currency bin being positioned within said enclosure so said partition walls vertically separate said horizontal slots;

a plurality of slidable bases for upwardly supporting said bill stacks, said slidable bases being horizontally disposed between and in frictional engagement with two opposing partition walls;

a plurality of biasing dogs radially attached to a rotating shaft, said rotating shaft being rotatably attached within said container and having one end extending to the exterior of said container, said rotating shaft disposed within said container so said biasing dogs fall coincident on said slidable bases;

a handle attached to the exterior end of said rotatable shaft for controlling said biasing dogs;

a pair of rollers horizontally disposed on the interior side of said horizontal slots one on top of the other;

drive means for rotating said rollers in opposing directions for drawing currency in through said slot to the interior of said container;

means for separating currency within said retaining means to segregate said currency by shift.

17. The currency sorter and storage device of claim 16 wherein the currency separation means comprises a plurality of sets of cards, each of said sets having a unique indicia thereon for signifying an individual shift.

18. The currency sorter and storage device of claim 17 wherein the currency separation means comprises a plurality of sets of folders, each of said sets having a unique indicia thereon for signifying an individual shift.

19. The currency sorter and storage device of claim 17 wherein the currency separation means comprises a plurality of sets of envelopes, each of said sets having a unique indicia thereon for signifying an individual shift.

* * * * *